US006375016B1

(12) United States Patent
Stuchlik, III

(10) Patent No.: US 6,375,016 B1
(45) Date of Patent: Apr. 23, 2002

(54) KNIFE HOLDER WITH SAFETY LOCK

(76) Inventor: Charles F. Stuchlik, III, 38175 S. Mountain Site Dr., Saddlebrooke, Tucson, AZ (US) 85739

( * ) Notice: Subject to any disclaimer, the term of this patent is extended or adjusted under 35 U.S.C. 154(b) by 0 days.

(21) Appl. No.: 09/706,763

(22) Filed: Nov. 7, 2000

(51) Int. Cl.[7] ..... A47F 7/00

(52) U.S. Cl. ..... 211/70.7; 211/162; 248/37.3; 248/551; 312/334.23

(58) Field of Search ..... 211/70.7, 85.1, 211/94.01, 162; 278/37.3, 37.6, 551; D7/637, 638; 312/334.23, 334.24

(56) References Cited

U.S. PATENT DOCUMENTS 5,245,756 A 9/1993 Howell et al. ..... 30/298.4
5,655,672 A 8/1997 Stuchlik, III ..... 211/70.7

FOREIGN PATENT DOCUMENTS

DE 3043421 A1 * 7/1982 ..... A47J/47/16

* cited by examiner

*Primary Examiner*—Daniel P. Stodola
*Assistant Examiner*—Erica B Harris
(74) *Attorney, Agent, or Firm*—Oliff & Berridge PLC

(57) ABSTRACT

A knife holder includes a knife holding block having a plurality of knife holding slots, each slot for receiving a knife therein. The knife holder also includes a knife locking mechanism that is movably engaged with the knife holding block. The knife holding mechanism is selectively movable to alternately: (a) simultaneously lock knives located in all of the knife holding slots so that the knives cannot be removed from any of the knife holding slots, and (b) simultaneously unlock knives located in all of the knife holding slots so that the knives can be removed from all of the knife holding slots. When the knife holder is a slidable knife holder, in which the knife holding block is slidably mounted to a support, such as, for example, below a counter or cabinet, so as to be slidable between a retracted, stored position, and an extended position in which knives held in the knife holding slots are readily accessible, it is preferable to include a block locking mechanism that selectively locks the knife holding block in the retracted, stored position. The block locking mechanism preferably includes at least some of the structure that also functions as the knife locking mechanism.

25 Claims, 5 Drawing Sheets

KNIFE HOLDER WITH SAFETY LOCK

BACKGROUND OF THE INVENTION

1. Field of Invention

The invention relates to knife holders, such as knife holding blocks that hold a plurality of knives, and in particular to knife holders having safety locks that prevent the knives from being removed from the knife holder.

2. Description of Related Art

Knife holders for holding a plurality of knives, typically in the form of wooden blocks having a plurality of slots, are well known. The most common form of these knife holding blocks are designed to be placed on a countertop so that the knives will be readily accessible. Since the knives are readily accessible, it is desirable to include some type of locking mechanism to prevent the knives from being removed from the block, for example, by young children.

U.S. Pat. No. 5,245,756 discloses a lockable knife block in which a separate spring-loaded locking and latching device is provided for each of the slots in the knife block. Each of the devices engages a notch formed in the upper portion of the blade of each knife to prevent each of the knives from being removed from the knife block. While effective, the knife block is large and bulky, and a large amount of hardware is required in order to lock all of the knives in the knife holder because a separate locking device is required for each knife.

While the typical knife block is designed for placement on a countertop, countertop space is rather limited in many homes, particularly for mobile homes and other recreational vehicles, which typically include very small kitchens and even smaller countertops. Additionally, since mobile homes and recreational vehicles are moved from place to place, it is highly desirable to provide a locking mechanism to prevent the knives from inadvertently being displaced from the knife holder during movement of the vehicle.

U.S. Pat. No. 5,655,672, to the inventor of the present invention, discloses a slidable knife holder that occupies a small amount of space, and can be readily mounted, for example, under or in cabinets, over sinks, or under counters. Additionally, the knife holder is slidably mounted so that it can be moved between a retracted position, where it is stowed out of the way, and an extended position, where the knives can be accessed. The disclosure of U.S. Pat. No. 5,655,672 is incorporated herein by reference in its entirety.

The slidable knife holder disclosed in U.S. Pat. No. 5,655,672, does not include any locking mechanism to prevent the knives from being accidentally removed from their slots, or to prevent the knife holder from accidentally sliding from the retraced position to the extended position.

Thus, there is a need for a knife holder that includes a simple locking mechanism for locking a plurality of knives in a knife holding block. There also is a need for a slidable knife holder that can be locked in the retracted position.

SUMMARY OF THE INVENTION

It is one object of embodiments of the invention to provide a knife holder that addresses the shortcomings in previous devices described above.

According to one aspect of the invention, a knife holder includes a knife holding block having a plurality of knife holding slots, each slot for receiving a knife therein. The knife holder also includes a knife locking mechanism that is movably engaged with the knife holding block. The knife holding mechanism is selectively movable to alternately (a) simultaneously lock knives located in all of the knife holding slots so that the knives cannot be removed from any of the knife holding slots, and (b) simultaneously unlock knives located in all of the knife holding slots so that the knives can be removed from all of the knife holding slots.

According to one embodiment, the knife locking mechanism includes a locking member that is selectively movable between an unlocked position and a locked position. When in the unlocked position, the locking member is not located in any of the knife holding slots such that the knives can be removed from all of the slots. When in the locked position, the locking member is located in all of the knife holding slots such that knives cannot be removed from any of the knife holding slots. Preferably, the locking mechanism also includes a biasing element, for example, a spring, that biases the locking member toward the unlocked position.

According to one embodiment, each of the knives includes an engagement portion, for example, a notch located in a blade portion of each of the knives. The knife locking member of the knife locking mechanism simultaneously engages the engagement portion (notch) of the knives located in all of the knife holding slots in order to simultaneously lock the knives in all of the knife holding slots.

When the knife holder is a slidable knife holder, the knife holder preferably includes a slidable mount having first and second portions. The first portion is attached to the knife holding block, whereas the second portion includes an attachment element that enables the second portion to be mounted to a support, such as a cabinet or the under surface of a counter. The second portion is slidably engaged with the first portion such that the knife holding block is slidable relative to the second portion between a retracted, stored position, and an extended position in which knives held in the knife holding slots are readily accessible. In this embodiment, it is preferable to include a block locking mechanism that selectively locks the knife holding block in the retracted, stored position. The block locking mechanism preferably includes a block locking portion that is engageable with the second portion of the slidable mount when the knife holding block is located in the retracted, stored position in order to lock the knife holding block in the retracted, stored position.

According to a preferred embodiment, the block locking portion is a surface of the movable locking element that also functions to lock the knives in the slots of the knife holding block. Accordingly, a simple structure can be provided that simultaneously locks the knife holding block in the retracted, stored position while locking the knives in their respective slots of the knife holding block.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

A preferred embodiment of the invention is illustrated in FIGS. 1–7. The preferred embodiment is a slidable knife holder that extends primarily in a vertical direction (as compared, for example, to a horizontal direction) when viewed from the front. This arrangement is preferable because it occupies only a small amount of space in the horizontal (lateral) direction. This enables the knife holder to be readily mounted under counters or cabinets or to the side of surfaces such as a cabinet sidewall or a vertically extending wall.

The invention, however, is not limited to the preferred embodiment. The invention is equally applicable to knife holders having blocks that extend, for example, in the horizontal direction as illustrated in the above-incorporated U.S. Pat. No. 5,655,672 (see, e.g., FIGS. 8–11 of that patent). Additionally, the aspect of the invention pertaining to a locking mechanism that simultaneously locks a plurality of knives within the plurality of slots located in a knife holding block is applicable to more standard knife holders that are not slidably mounted. For example, this aspect of the invention can be applied to the typical knife holding block that is placed on a countertop.

Figure 1:
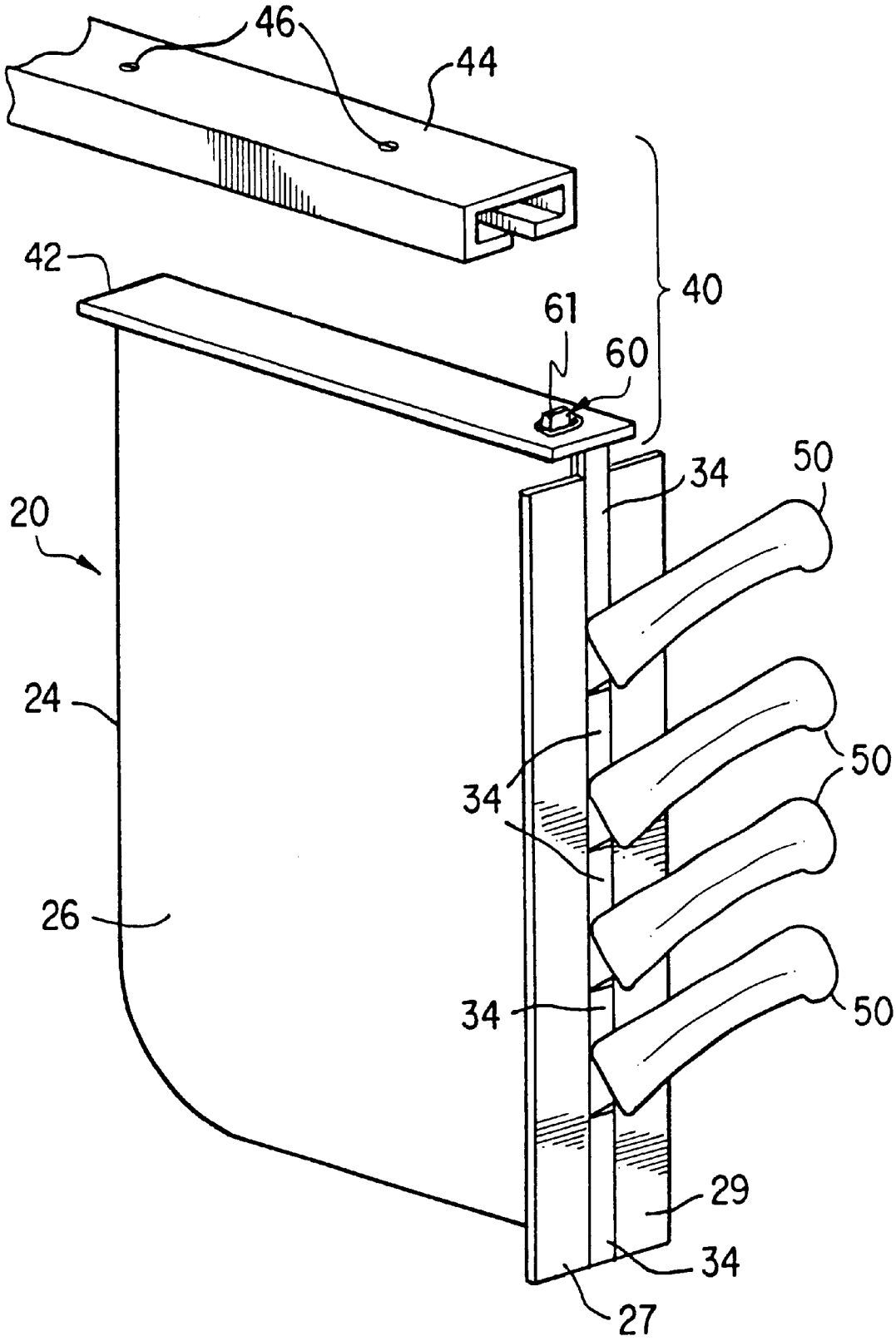
FIG. 1 is a perspective view of an embodiment of the invention in which a slidable knife holder extends predominately in a vertical direction.

Referring to FIG. 1, a vertically extending slidable knife holder 20 includes a knife holding block 24 that includes a first (left in the drawing) vertically extending sidewall 26 and a second (right in FIG. 2) vertically extending sidewall 28. A plurality of spacer elements 34 attach the vertical sidewall 26 to the vertical sidewall 28. The plurality of spacer elements are spaced from each other to define a plurality of knife holding slots 35. As is evident from FIG. 1, the inlet openings for the plurality of slots 35 extend in a vertical line between the vertical sidewall 26 and the vertical sidewall 28.

Figure 3:
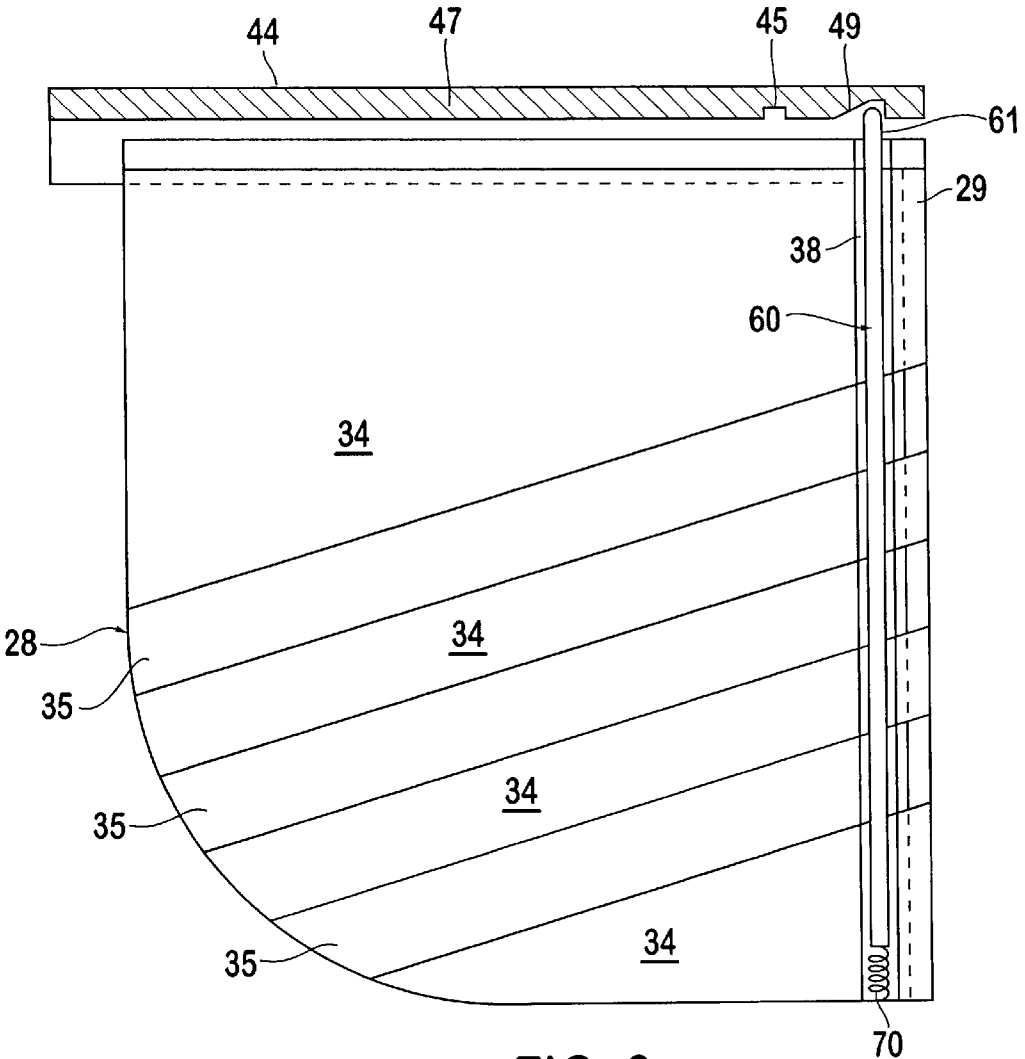
FIG. 3 is a side view of one of the side walls from the FIG. 1 embodiment, and illustrates portions of the locking mechanism for locking the knives in the slots of the knife holder and for locking the knife holder in its retracted, stored position.

FIG. 3 illustrates one manner in which the slots 35 can be formed between the vertical sidewalls 26, 28. FIG. 3 is a side view of the right vertical sidewall 28 as viewed from the left side in FIG. 1 (i.e., prior to attachment to the left vertical sidewall 26). In this example, the plurality of spacer elements 34 are glued to right vertical sidewall 28 so as to form three slots 35 therein. The slots 35 preferably extend diagonally so that the knives 50 will not fall out of the knife holder 20 when mounted. The left sidewall 26 then would be glued, or otherwise attached, to the right sidewall 28 via the spacer elements 34.

It is convenient to make the knife holding block 24 from plastic because plastic spacer elements 34 can be glued between the plastic sidewalls 26, 28. As one alternative, it is possible to glue spacer elements 34 to one of the sidewalls, for example, sidewall 28, and then attach the other sidewall 26 using detachable fasteners such as screws or clips, for example. Nondetachable fasteners such as rivets, for example, also can be used.

As another alternative, the spacer elements can be one-piece with one of the sidewalls (or some of the spacer elements can be one-piece with one sidewall, and other spacer elements can be one-piece with the other sidewall). For example, when using plastic, the spacer elements can be molded into one or both of the sidewalls. The sidewalls can then be attached to each other either detachably (e.g., with screws or clips) or non-detachably (e.g., with glue).

When constructing with wood, separate wood spacer elements can be used or the spacer elements can be formed into one or both of the sidewalls by using, for example, a router. As with the plastic version, the sidewalls and/or spacer elements can be inter-connected using glue, rivets, screws, etc.

Although four spacer elements 34 are shown that provide three slots, more or less spacer elements and slots can be provided. Additionally, the spacer elements could be made wider (laterally) and spaced closer together (vertically) so that each slot would extend left-to-right instead of straight-up-and-down as in FIG. 1. While such an arrangement would have a greater lateral dimension, it would have a much smaller vertical dimension and therefore would provide a very compact knife holder. As another alternative, the spacer elements can be shaped so that each slot extends diagonally.

In order to provide for the slidable mounting of the knife holder, a first part 42 of a slidable mount 40 is provided on the top of the knife holding block 24. In the FIG. 1 embodiment, a rectangular piece of plastic 42 is glued to the top of the top spacer element 34 and to the tops of the sidewalls 26 and 28. As can be seen from FIG. 2, when viewed from the front, this results in a T-shaped structure that includes left lateral wing 42*a* and right lateral wing 42*b*.

A second part of the slidable mount 40 is defined by a bracket 44. Bracket 44 includes attachment elements such as, for example, screws 46 that enable the bracket 44 to be fixedly mounted to a support such, for example, the underside of a counter or cabinet. The lateral wings 42*a* and 42*b* are received in slots 44*a* and 44*b* of the bracket 44 so that the plastic piece 42 and bracket 44 are slidable relative to each other in a horizontal direction (when mounted).

The knife holding block 24 moves along with plastic piece 42 in the horizontal direction so that the block 24 moves from a retracted position to an extended position.

Figure 2:
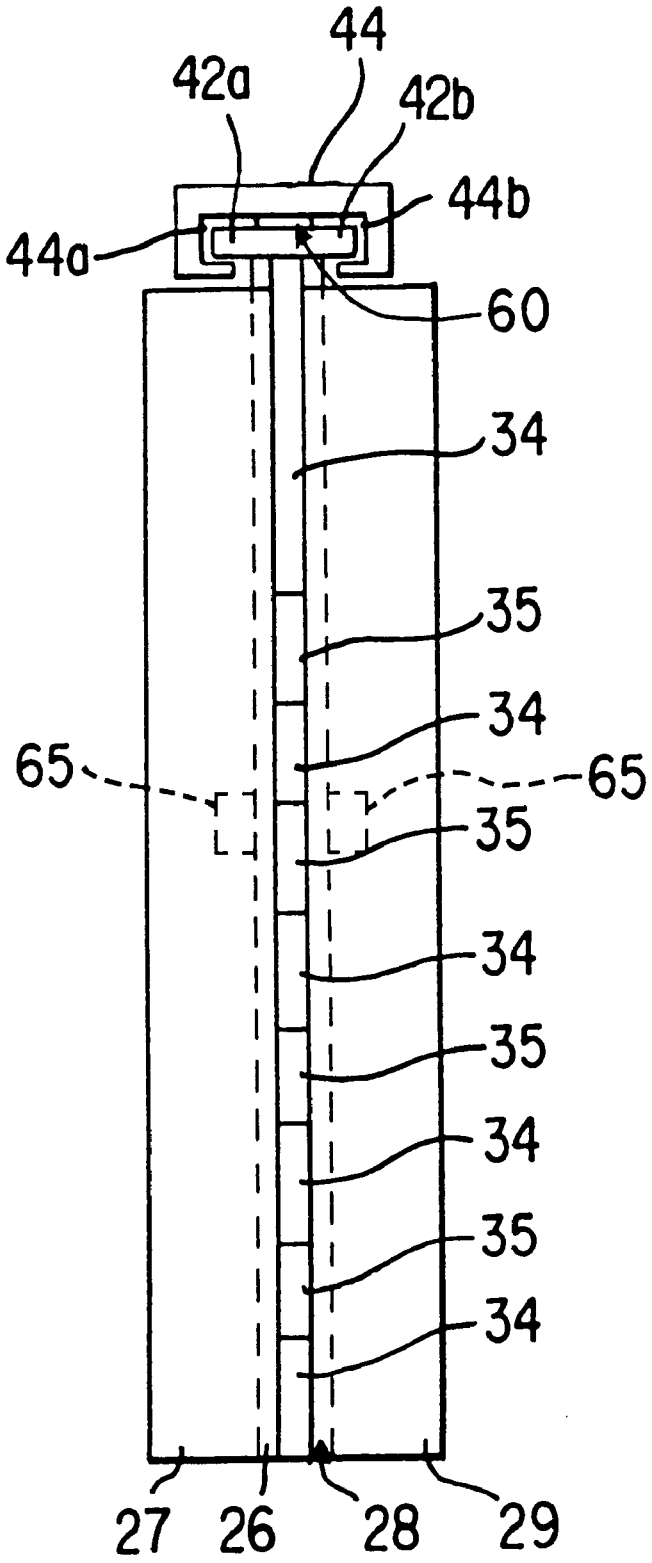
FIG. 2 is a front view of the FIG. 1 knife holder.

In order to provide for easy grasping of the knife holding block 24 so that it can be moved between the retracted position and the extended position, it is preferable to provide a handle or other type of grasping structure on the knife holding block. As shown in FIGS. 1 and 2, laterally extending grasping members 27 and 29 are glued to the front portions of the sidewalls 26 and 28 respectively. Although the grasping members 27 and 29 are illustrated as extending substantially the entire height of each sidewall 26, 28, respectively, it is possible to provide the grasping member on only a portion of one or both of the sidewalls.

The locking mechanism according to the invention will now be described. The locking mechanism according to one embodiment includes an elongated, vertically extending locking member 60. The locking member 60 is slidably mounted within a bore 38 provided in the knife holding block 24. As illustrated in FIG. 3, the bore 38 extends through substantially the entire height of the knife holding block 24. In particular, the bore 38 preferably extends from the top of the knife holding block 24 downward through all of the slots 35. The locking member 60 is vertically movable within bore 38, and has a lower end that is engaged with a spring 70, and an upper end 61 which extends above the upper surface of the first part 42 of the slidable mount 40 as illustrated in FIGS. 1 and 3. The spring 70 urges the locking member 60 upwardly, and can be compressed to allow the locking member 60 to move downwardly when the upper portion 61 of the locking member is pressed down. The spring 70 is a helical spring, although other forms of biasing members also can be used with the invention.

Figure 4:
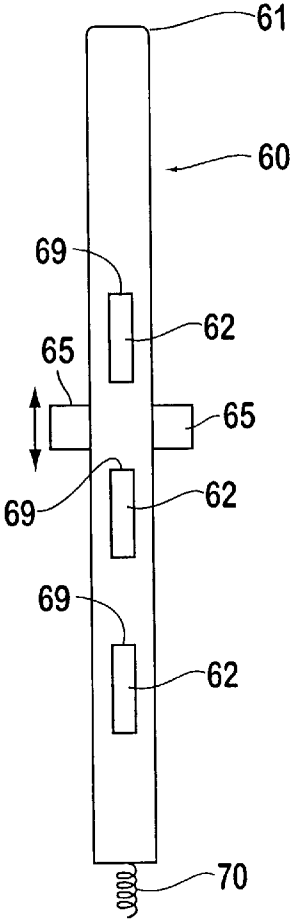
FIG. 4 is a front view of the locking member of the FIG. 3 locking mechanism.
Figure 5:
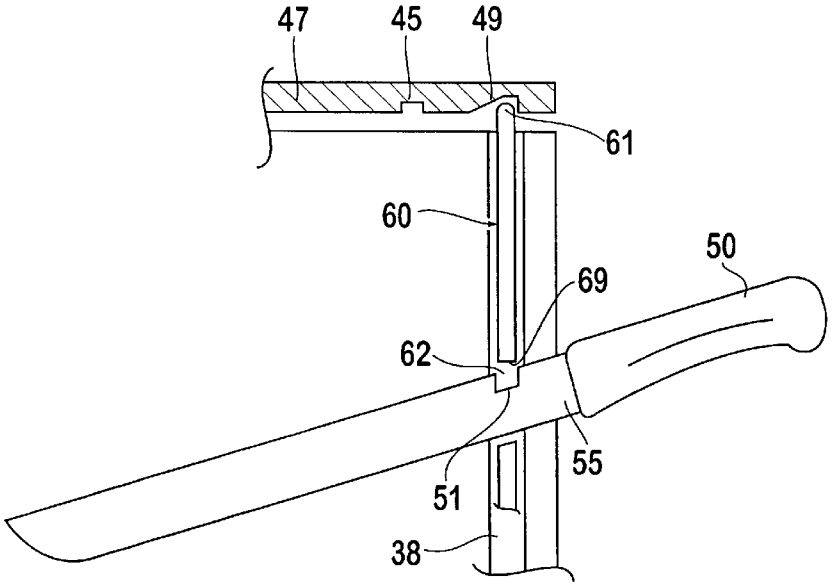
FIG. 5 illustrates the position of the locking member in its unlocked position.

As illustrated in FIG. 4, the locking member 60 includes a plurality of openings 62, which correspond in number to the plurality of slots 35 provided in the knife holding block 24. When the knife holding block is located in the unlocked position, illustrated in FIGS. 3 and 5, with the spring 70 fully extended, the openings 62 are aligned with their respective slots 35 such that knives can be readily moved into and out of each slot without contacting the locking member 60. This relationship is best illustrated in FIG. 5.

The upper wall 47 of the mounting bracket 44 includes an inclined front notch 49 illustrated in FIGS. 3 and 5–7. A locking notch 45 is located in the lower surface of upper wall 47 a distance behind the inclined notch 49. Thus, when the knife holding block 24 is moved toward its retracted position (i.e., when the knife holding block 24 is moved in the left direction of FIG. 3), the upper part 61 of the locking member 60 will engage with the ramped portion of the inclined notch 49. As the knife holding block 24 is moved further towards the fully retracted position (i.e., the left-most position), movement of the upper part 61 along the ramped portion of the inclined notch 49 will cause the locking member 60 to move downward against the urging force of spring 70. This will cause the upper surfaces 69 of the openings 62 to move into their respective slots 35.

When the knife holding block 24 is moved into its fully retracted position, the urging force of spring 70 will cause the upper part 61 of locking member 60 to move slightly upward into notch 45. This will lock the knife holding block 24 in its fully retracted position.

Handles 65 are provided on both sides of the locking member 60, and extend through the respective walls 26 and 28 of the knife holding block 24 as illustrated in FIG. 2. The handles 65 preferably are located behind the respective grasping members 27 and 29 so that they cannot be seen when the knife holding block 24 is viewed from the front. This decreases the likelihood that the locking member will be unlocked by young children and improves the aesthetics of the overall device.

In order to unlock the locking mechanism, a user simply moves one of the handles 65 downward so that the upper part 61 of locking member 60 is disengaged from the notch 45. The user then moves the knife holding block 24 forward (in the right direction of FIG. 3) in order to move the knife holding block 24 toward the extended position. As the knife holding block 24 is moved forward, the upper part 61 of the locking member 60 rides up the ramped portion of the inclined notch 49.in the lower surface 47 of bracket 44, which causes locking member 60 to move upward, into its unlocked position, as a result of the urging force of spring 70. In one embodiment, notch 45 has a depth of about 1/16 inches, whereas inclined notch 49 has a maximum depth of about 1/8 inches.

Figure 6:
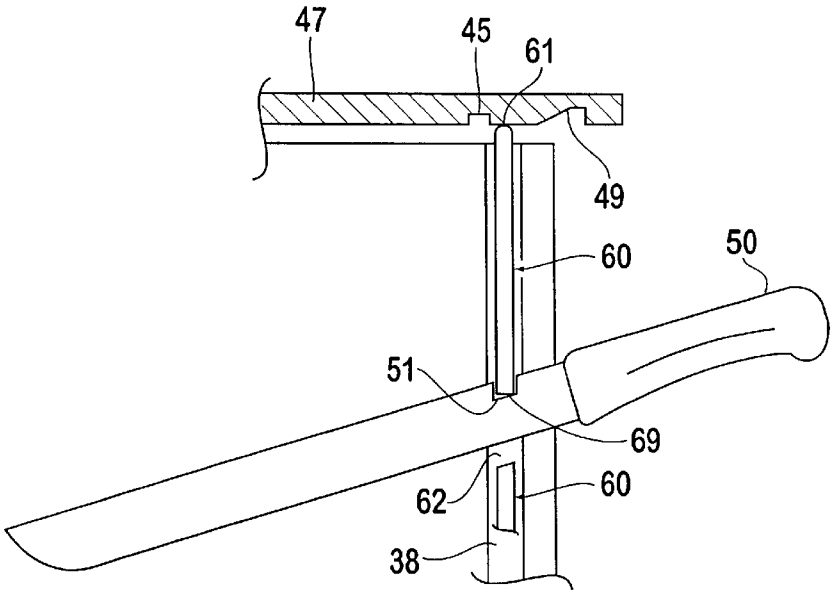
FIG. 6 illustrates the position of the locking member just before the knife holding block is located in its fully retracted position.
Figure 7:
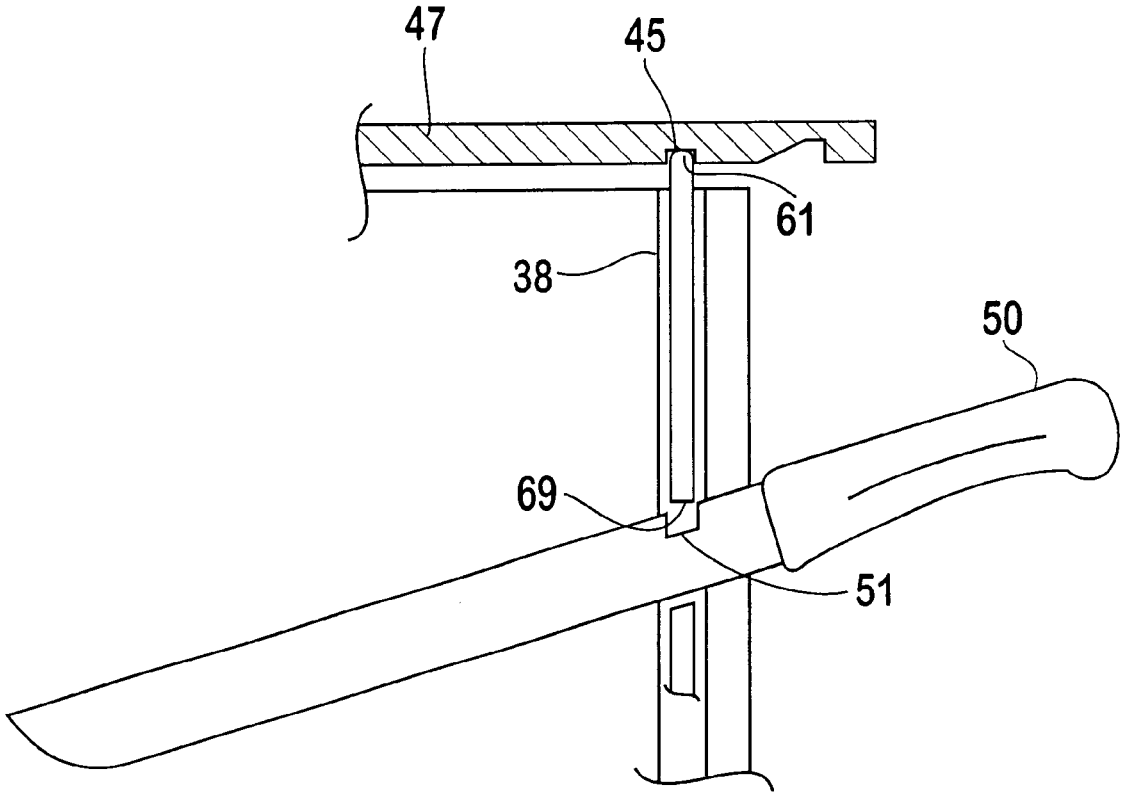
FIG. 7 illustrates the location of the locking member when the knife holding block is located in its fully retracted position.

The location of the locking member and its interaction with the knives is illustrated in more detail in FIGS. 5–7. These figures illustrate only one knife, although it is understood that the same relationship exists between the locking member 60 and all of the knives, which are simultaneously acted upon by the locking member 60.

As illustrated in FIGS. 5–7, each knife includes an engagement portion, such as a notch 51 in its blade 55. Accordingly, when the knife holding block 24 is located in its extended position, the locking member 60 is positioned as illustrated in FIG. 5, such that each of the openings 62 of the locking member 60 is aligned with its respective slot 35, and therefore the locking member 60 does not interfere with movement of the knives through the slots 35.

As the block 24 is moved from the fully extended position toward the retracted position, upper part 61 of locking member 60 rides along the ramped surface of the inclined notch 49. As described earlier, this causes the locking member 60 to move downward against the urging force of spring 70. Once past the inclined notch 49, the locking member 60 is located in its lowest position as illustrated in FIG. 6. In this position, the upper surface 69 of each opening 62 extends into its respective slot 35 and into the notch 51 of the knife located in its slot 35. Thus, none of the knives 50 can be removed from the knife holding block 24.

Upon further leftward movement of knife holding block 24, the upper part 61 of locking member comes into engagement with notch 45 in the lower surface of upper wall 47, as illustrated in FIG. 7. This causes the locking member 60 to move slightly upward. However, as illustrated in FIG. 7, the upper surface 69 of each opening 62 still extends into the notch 51 of the knife located in its corresponding slot 35. Accordingly, the knives 50 continue to be locked within the knife holding block 24. Additionally, the knife holding block 24 is now positively locked in its retracted, stored position by engagement of upper part 61 with notch 45.

When it is desired to unlock the knife holding block 24 and the knives 50, one of the handles 65 provided on the locking member 60 is moved downward, and then the knife holding block 24 is moved from the retracted position toward its extended position as described previously.

The invention is advantageous in that a simple mechanism is provided that simultaneously locks all knives in place. Thus, when a user desires to use one or more knives, the knife holder can be unlocked by a simple operation, and all knives can be accessed. Furthermore, the knives can be locked into their locked position simply by moving the knife holding block 24 into its retracted position.

The locking member 60 need not have the specific structure illustrated in the drawings. It simply needs to extend across all of the slots 35 located in the knife holder, and to include portions that are movable into and out of each slot simultaneously.

The structure defining the knife locking mechanism and the block locking mechanism could be entirely separate structures, or as illustrated in the drawings, could share some structure (i.e., the locking member 60 and the spring 70).

A knife holding block could include only a knife locking mechanism, only a block locking mechanism or both mechanisms as in the preferred embodiment. If only the knife locking mechanism is provided on a stationary block, some sort of actuator to cause the locking member 60 to move between its knife-locking and knife-unlocking positions would be provided on the block, for example.

While the present invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. A knife holder comprising:

a knife holding block including a plurality of knife holding slots, each slot for receiving a knife therein; and a knife locking mechanism, moveably engaged with the knife holding block, the knife locking mechanism is selectively moveable to alternately (a) simultaneously lock knives located in all of the knife holding slots so that the knives cannot be removed from any of the knife holding slots, and (b) simultaneously unlock knives located in all of the knife holding slots so that the knives can be removed from all of the knife holding slots;

the knife holding block includes a bore that intersects the plurality of knife holding slots, and the knife locking mechanism includes a locking member that is movably located in the bore and that is selectively moveable between an unlocked position in which the locking member is not located in any of the knife holding slots, and a locked position in which the locking member is located in all of the knife holding slots.

2. The knife holder of claim 1, wherein the locking mechanism further includes a biasing element that biases the locking member toward the unlocked position.

3. The knife holder of claim 1, further comprising:

a plurality of knives equal in number to the number of knife holding slots, each of the plurality of knives located in a corresponding one of the plurality of knife holding slots, wherein:

each of the knives includes an engagement portion, and the locking member simultaneously engages the engagement portion of the knives located in all of the knife holding slots in order to simultaneously lock the knives in all of the knife holding slots.

4. The knife holder of claim 3, wherein the engagement portion is a notch located in a blade portion of each of the plurality of knives.

5. The knife holder of claim 1, further comprising:

a slidable mount having a first portion attached to the knife holding block, and a second portion including an attachment element that enables the second portion to be mounted to a support, the second portion being slidably engaged with the first portion such that the knife holding block is slidable relative to the second portion between a retracted, stored position and an extended position in which knives held in the knife holding slots are readily accessible.

6. The knife holder of claim 5, further comprising:

a block locking mechanism that selectively locks the knife holding block in the retracted, stored position.

7. The knife holder of claim 6, wherein the block locking mechanism includes a movable locking element that selectively and fixedly engages the knife holding block with the second portion of the slidable mount to lock the knife holding block in the retracted, stored position.

8. The knife holder of claim 7, wherein the movable locking element is movably mounted to the knife holding block and includes a locking portion that selectively engages the second portion of the slidable mount to lock the knife holding block in the retracted, stored position.

9. The knife holder of claim 7, wherein the block locking mechanism includes a biasing element that biases the movable locking element into a locked position.

10. The knife holder of claim 9, wherein the block locking mechanism includes a handle attached to the movable locking element by which a user can move the movable locking element out of the locked position.

11. The knife holder of claim 1, further comprising:

a slidable mount having a first portion attached to the knife holding block, and a second portion including an attachment element that enables the second portion to be mounted to a support, the second portion being slidably engaged with the first portion such that the knife holding block is slidable relative to the second portion between a retracted, stored position and an extended position in which knives held in the knife slots are readily accessible; and wherein the locking member includes a block locking portion that is engagable with the second portion of the slidable mount when the knife holding block is located in the retracted, stored position and the locking member is located in the locked position in order to lock the knife holding block in the retracted, stored position.

12. The knife holder of claim 11, wherein the locking mechanism further includes a biasing element that biases the locking member toward the unlocked position and that biases the block locking portion toward the second portion of the slidable mount.

13. The knife holder of claim 12, wherein when the knife holding block is located in the retracted, stored position, the second portion of the slidable mount prevents the locking member from moving to the unlocked position.

14. The knife holder of claim 13, wherein the locking member includes a handle by which a user can move the locking member against the bias of the biasing element to move the block locking portion out of the locked position, and by which the user can slide the knife holding block out of the retracted, stored position, thereby moving the locking member out of engagement with the second portion of the slidable mount so that when the handle is released with the knife holding block in the extended position, the locking member will move to the unlocked position.

15. A slidable knife holder comprising:

a knife holding block including a plurality of knife holding slots, each slot for receiving a knife therein;

a slidable mount having a first portion attached to the knife holding block, and a second portion including an attachment element that enables the second portion to be mounted to a support, the second portion being slidably engaged with the first portion such that the knife holding block is slidable relative to the second portion between a retracted, stored position and an extended position in which knives held in the knife slots are readily accessible; and a locking mechanism, moveably engaged with the knife holding block, the locking mechanism is selectively moveable between (a) a locked position in which the locking mechanism locks the knife holding block in the retracted, stored position while also locking knives within all of the knife holding slots so that the knives cannot be removed from any of the knife holding slots, and (b) an unlocked position in which the knife holding block can be moved out of the retracted, stored position while also unlocking the knives located in all of the knife holding slots so that the knives can be removed from all of the knife holding slots.

16. The slidable knife holder of claim 15, wherein:

the locking mechanism includes a locking member that is movable between the locked position and the unlocked position, and that has a plurality of knife locking portions and a block locking portion;

each of the plurality of knife locking portions engages a knife located in a corresponding one of the knife holding slots when the locking member is located in the locked position;

the block locking portion engages an engagement member of the second portion of the slidable mount when the locking member is located in the locked position;

the locking mechanism also includes a biasing element that biases the locking member toward the unlocked position and that biases the block locking portion toward the second portion of the slidable mount.

17. The slidable knife holder of claim 16, wherein when the knife holding block is located in the retracted, stored position, the second portion of the slidable mount prevents the locking member from moving to the unlocked position.

18. The slidable knife holder of claim 17, wherein the locking member includes a handle by which a user can move the locking member against the bias of the biasing element to move the block locking portion out of engagement with the engagement member and out of the locked position, and by which the user can slide the knife holding block out of the retracted, stored position, thereby moving the locking member out of engagement with the second portion of the slidable mount so that when the handle is released with the knife holding block in the extended position, the locking member will move to the unlocked position.

19. The slidable knife holder of claim 18, wherein the engagement portion is a notch located in the second portion of the slidable mount, the slidable mount also including a ramp portion adjacent to the notch and that engages the block locking portion of the locking member as the knife holding block slides into the retracted, stored position, thereby causing the knife locking portions of the locking member to move into locking engagement with knives located in the knife holding slots as the knife holding block slides into the retracted, stored position.

20. A slidable knife holder comprising:

a knife holding block including a plurality of knife holding slots, each slot for receiving a knife therein;

a slidable mount having a first portion attached to the knife holding block, and a second portion including an attachment element that enables the second portion to be mounted to a support, the second portion being slidably engaged with the first portion such that the knife holding block is slidable relative to the second portion between a retracted, stored position and an extended position in which knives held in the knife slots are readily accessible; and a block locking mechanism, moveably engaged with the knife holding block, the block locking mechanism is selectively moveable between (a) a locked position in which the block locking mechanism locks the knife holding block in the retracted, stored position, and (b) an unlocked position in which the knife holding block can be moved out of the retracted, stored position.

21. The slidable knife holder of claim 20, wherein:

the block locking mechanism includes a locking member that is movable between the locked position and the unlocked position, and that has a block locking portion;

the block locking portion engages an engagement member of the second portion of the slidable mount when the locking member is located in the locked position;

the block locking mechanism also includes a biasing element that biases the locking member toward the unlocked position and that biases the block locking portion toward the second portion of the slidable mount.

22. The slidable knife holder of claim 21, wherein when the knife holding block is located in the retracted, stored position, the second portion of the slidable mount prevents the locking member from moving to the unlocked position.

23. The slidable knife holder of claims 22, wherein the locking member includes a handle by which a user can move the locking member against the bias of the biasing element to move the block locking portion out of engagement with the engagement member and out of the locked position, and by which the user can slide the knife holding block out of the retracted, stored position, thereby moving the locking member out of engagement with the second portion of the slidable mount so that when the handle is released with the knife holding block in the extended position, the locking member will move to the unlocked position.

24. The slidable knife holder of claim 23, wherein the engagement portion is a notch located in the second portion of the slidable mount.

25. A knife holder comprising:

a knife holding block including a plurality of knife holding slots, each slot for receiving a knife therein; and a knife locking mechanism, moveably engaged with the knife holding block, the knife locking mechanism is movable linearly back-and-forth between a locked position and an unlocked position, when in the locked position the knife locking mechanism simultaneously locks knives located in all of the knife holding slots so that the knives cannot be removed from any of the knife holding slots, and when in the unlocked position the knife locking mechanism simultaneously unlocks knives located in all of the knife holding slots so that the knives can be removed from all of the knife holding slots.

* * * * *